US011484088B2

(12) United States Patent
Caulk et al.

(10) Patent No.: US 11,484,088 B2
(45) **Date of Patent: *Nov. 1, 2022**

(54) FOLDABLE SHOE

(71) Applicant: Cassidy Ray, LLC, Charleston, SC (US)

(72) Inventors: Cassidy Caulk, Charleston, SC (US); Jonathan Mark Dalton, Marietta, GA (US); Clay Griffin Prickett, Atlanta, GA (US)

(73) Assignee: Kindred Label, LLC, Charleston, SC (US)

( * ) Notice: Subject to any disclaimer, the term of this patent is extended or adjusted under 35 U.S.C. 154(b) by 123 days.

This patent is subject to a terminal disclaimer.

(21) Appl. No.: 17/100,031

(22) Filed: Nov. 20, 2020

(65) Prior Publication Data

US 2021/0085016 A1 Mar. 25, 2021

Related U.S. Application Data

(63) Continuation-in-part of application No. 16/900,551, filed on Jun. 12, 2020, now Pat. No. 11,330,859.

(Continued)

(51) Int. Cl.

*A43B 3/24* (2006.01)
*A43B 3/10* (2006.01)

(Continued)

(52) U.S. Cl.

CPC ..... *A43B 3/248* (2013.01); *A43B 1/0054* (2013.01); *A43B 3/108* (2013.01); *A43B 3/128* (2013.01); *A43B 3/246* (2013.01); *A43B 13/141* (2013.01)

(58) Field of Classification Search

CPC ..... A43B 3/248; A43B 3/24; A43B 3/246; A43B 1/0054

(Continued)

(56) References Cited

U.S. PATENT DOCUMENTS 2,177,571 A * 10/1939 Kirke ..... A43B 3/128 D2/916
3,121,962 A * 2/1964 Gullo ..... A43B 3/128 36/11.5

(Continued)

FOREIGN PATENT DOCUMENTS

CN 201365610 Y 12/2009
CN 202774390 U 3/2013

(Continued)

*Primary Examiner* — Marie D Bays
(74) *Attorney, Agent, or Firm* — Haynsworth Sinkler Boyd, P.A.

(57) ABSTRACT

A foldable shoe includes a first sole section located under the ball of a wearer's foot including a first outsole portion and a first footbed. The foldable shoe further includes a second sole section located under the heel of a wearer's foot, the second sole section including a second outsole portion and a second footbed. An upper section extends from the first sole section, and a hinge is connected to the first sole section and the second sole section and is configured to fold the foldable shoe from a first position, to be worn, to a second position, for storage. A first magnetic material disposed in the first sole section and a second magnetic material disposed in the second sole section creates a magnetic connection to retain the foldable shoe in first position or second position.

19 Claims, 9 Drawing Sheets

Related U.S. Application Data

(60) Provisional application No. 62/879,047, filed on Jul. 26, 2019.

(51) Int. Cl.
*A43B 13/14* (2006.01)
*A43B 3/12* (2006.01)
*A43B 1/00* (2006.01)

(58) Field of Classification Search
USPC ..... 36/100, 102
See application file for complete search history.

(56) References Cited

U.S. PATENT DOCUMENTS

| | | | | |
|---|---|---|---|---|
| 7,448,148 | B2 * | 11/2008 | Martinez | A43B 1/0054 36/102 |
| 7,694,435 | B1 | 4/2010 | Kiser et al. | |
| 8,661,714 | B2 | 3/2014 | Sussmann | |
| 9,089,184 | B1 * | 7/2015 | Kiser | A43B 3/108 |
| 9,398,786 | B2 | 7/2016 | Gavrieli et al. | |
| 10,736,376 | B2 * | 8/2020 | Anderson | A43B 3/248 |
| 11,330,859 | B2 * | 5/2022 | Caulk | A43B 3/248 |
| 2010/0018080 | A1 | 1/2010 | Smith | |
| 2011/0016748 | A1 | 1/2011 | Soler | |
| 2011/0094125 | A1 | 4/2011 | Weightman | |
| 2011/0214312 | A1 | 9/2011 | Krikelis | |
| 2014/0310992 | A1 | 10/2014 | Shalom et al. | |
| 2014/0373396 | A1 | 12/2014 | Chang | |
| 2017/0119087 | A1 | 5/2017 | Gavrieli et al. | |
| 2017/0224054 | A1 | 8/2017 | Zeng | |
| 2021/0085016 | A1 * | 3/2021 | Caulk | A43B 13/141 |

FOREIGN PATENT DOCUMENTS

| | | | |
|---|---|---|---|
| CN | 203457874 | U | 3/2014 |
| CN | 204306129 | U | 5/2015 |
| CN | 204763651 | U | 11/2015 |
| CN | 105192997 | A | 12/2015 |
| CN | 104000348 | B | 9/2017 |
| GB | 2513096 | A | 10/2014 |
| JP | 04150802 | A | 5/1992 |
| KR | 100985219 | B1 | 9/2010 |
| KR | 1020130103215 | A | 9/2013 |
| KR | 1020150005581 | A | 1/2015 |
| KR | 1020170083017 | A | 7/2017 |
| WO | 2010060158 | A1 | 6/2010 |

* cited by examiner

FOLDABLE SHOE

BACKGROUND

This application claims priority to U.S. Non-Provisional patent application Ser. No. 16/900,551 filed on Jun. 12, 2020, which claims priority to U.S. Provisional Patent Application No. 62,861,579 filed on Jun. 14, 2019 and U.S. Provisional Patent Application No. 62,879,047 filed on Jul. 26, 2019, the entire contents of such applications being fully incorporated herein by reference.

BACKGROUND

Many times, people wear uncomfortable shoes to an event and, after putting up with the discomfort for an acceptable period of time, change into a different pair of shoes at the event once the need to wear the first pair of shoes ends. Others simply endure the discomfort of the first pair of shoes for the entire duration of the event, either because they have no way to carry an extra pair of shoes to the event or because easy-to-carry shoes, like flip-flops, may not be acceptable to wear to the event. For example, women may wear heels to a formal event, like a wedding or party, and would like to change into more comfortable shoes, like sandals, for a reception or after party. Carrying the second pair of shoes is cumbersome, as many types of shoes do not easily fit within a pocket, purse, etc. Additionally, traditional shoes take up much needed space in closets, drawers, etc. What is needed is a way to reduce the size of shoes to make them easier to store and/or transport.

SUMMARY

According to the disclosure herein, a foldable shoe includes a first sole section configured to be positioned under the ball of a wearer's foot. The first sole section includes a first outsole portion configured to contact the ground when the foldable shoe is worn and a first footbed configured to receive a user's foot when the foldable shoe is worn. The foldable shoe further includes a second sole section that is separate from the first sole section and is configured to be positioned under the heel of a wearer's foot, the second sole section including a second outsole portion configured to contact the ground when the foldable shoe is worn and a second footbed configured to receive a user's heel when the foldable shoe is worn. An upper section extends from the first sole section, and a hinge connects to the first sole section and the second sole section. The hinge is configured to fold the foldable shoe from a first position, in which the foldable shoe is configured to be worn, to a second position, in which either the first outsole section and second outsole section fold toward one another or the first footbed and second footbed fold toward one another. The foldable shoe may include a retainer configured to maintain the foldable shoe in one of the first position or the second position. The hinge may include a first hinge section connected to the first sole section, a second hinge section connected to the second sole section and a hinge mechanism, the hinge mechanism being connected to the first hinge section and the second hinge section and configured to permit the foldable shoe to fold. The first hinge section may include a first stop positioned within a first cavity of the first sole section, the first cavity being configured to allow a portion of first hinge section to slide out of first sole section. The second hinge section may include a second stop positioned within a second cavity of the second sole section, the second cavity being configured to allow a portion of second hinge section to slide out of second sole section. As a result, the first sole section and second sole section may slide apart from one another. The hinge mechanism may include at least one of: a spring hinge, a barrel hinge, a pivot hinge, a butt/mortise hinge, a case hinge, a continuous hinge, a butterfly hinge, a flag hinge, a strap hinge, a counterflap hinge, a flush hinge, a coach hinge, a rising butt hinge, a double action hinge, a tee hinge, or a friction hinge. The first hinge section may include a slide and a slide member disposed in a channel of the slide, the hinge mechanism being connected to the slide member. The slide member may include a slide stop and be configured to move within the channel from a first channel end, when in the first position, to a second channel end, when in the second position. A second hinge mechanism may be connected to the second hinge section. A hinge plate may extend from the second hinge section, the hinge plate including a hinge plate surface that contacts a slide surface, of the slide, when the foldable shoe is in the first position. A retainer may be connected to the hinge, the retainer engaging a recess in first sole section to maintain the foldable in the first position. The hinge may further include a first section connected to the first sole section, a second section connected to the second sole section, and a hinge section connected to the second section and being connectable to the first section. The hinge section may include a clamp and the first section may include a post, so that the hinge section connects to the first section when the clamp engages the post. The hinge may further include a slide member having a head connected to the first sole member, a neck extending from the head and a key connected to the neck opposite the head, and slide connected to the second sole section. The slide member may be movable along a slide channel of the slide from a folding position to the first position. The slide includes a lock that engages the key in the first position and disengages from the key in the folding position, and the neck is foldable to place the foldable shoe in the second position when the slide member is in the folding position. The key may further include a slot configured to be compressed to allow the key to engage the lock. A cover may be connected to the slide over the slide channel and the lock. The slide member may include a stop extending from the key and including a stop member so that the stop contacts the stop member when the foldable shoe is placed in the second position. The neck may be formed from a flexible material that bends to permit the neck to be folded. A head surface of the head may contact a slide surface of the slide when the foldable shoe is in the first position. A portion of the head may be disposed in the slide when the foldable shoe is in the first position. The hinge mechanism may consist of a single hinge.

According to another aspect of the present invention, a foldable shoe includes a first sole section configured to be positioned under the ball of a wearer's foot, the first sole section including a first outsole portion configured to contact the ground when the foldable shoe is worn and a first toothed configured to receive a user's foot when the foldable shoe is worn. The foldable shoe further includes a second sole section that is separate from the first sole section and is configured to be positioned under the heel of a wearer's foot, the second sole section including a second outsole portion configured to contact the ground when the foldable shoe is worn and a second footbed configured to receive a user's heel when the foldable shoe is worn. An upper section extends from the first sole section. A hinge is co peeled to the first sole section and the second sole section, the hinge configured to fold the foldable shoe from a first position, in which the foldable shoe is configured to be worn, to a second position, in which either the first outsole section and second outsole section fold toward one another, or the first footbed and second footbed fold toward one another. A first magnetic material is disposed in the first sole section and a second magnetic material disposed in the second sole section, the first magnetic material and second magnetic material creating a magnetic connection to retain the foldable shoe in the first position or the second position. The first sole section gray include a tab and the second sole section may include a tab recess, the tab being disposed in the tab recess when the shoe is in the first position. The hinge may further include a first hinge section connected to the first sole section, a second hinge section connected to the second sole section and a hinge mechanism, the hinge mechanism being connected to the first hinge section and the second hinge section and configured to permit the foldable shoe to fold. The first magnetic material may be disposed in the tab. The hinge mechanism may corresponds to a live hinge. The foldable shoe may further include a third magnetic material, and the magnetic connection may maintains the foldable shoe in the first position while a second magnetic connection between the second magnetic material and the third magnetic material maintains the foldable shoe in the second position. The first magnetic material, second magnetic material and third magnetic material may be formed from magnets. One of the first magnetic material, second magnetic material or third magnetic material may be formed from iron, nickel, cobalt, neodymium, samarium, or a magnetic rare earth metal or an alloy comprising iron, nickel, cobalt, neodymium, samarium, or a magnetic rare earth metal. The first magnetic material may be disposed in the tab and the second magnetic material may be disposed between the tab recess and the second outsole portion of the second sole section. The third magnetic material may be disposed in the first sole section. The upper section may be connected to the second sole section. A first hinge extension may be disposed adjacent to the first hinge section in the first sole section. A second hinge extension may the disposed adjacent to the second hinge section in the second sole section.

DETAILED DESCRIPTION

The apparatuses, assemblies, systems, methods and/or technologies (the "technology") described herein may provide for compact shoe design that can be folded from a first position, in which the shoe is intended to be worn, to a second position, which is more compact than the first position and in which the shoe is intended to be stored. The technology is described in FIGS. 1A-8C with reference to the example embodiments illustrated therein. The embodiments depicted in FIGS. 1A-8C are examples only, and the present technology may be embodied in many different embodiments in many different ways to produce a shoe that is foldable, collapsible, portable, etc. FIGS. 1A-8C are attached hereto and incorporated herein by reference.

The technology described herein may include a shoe that is foldable between a first position and a second position. The first position may correspond to the position that allows the user to wear the shoe (i.e. the typical position of a shoe). The second position may correspond to a compact position in which the shoe is folded to make the shoe easier to transport, store, etc. The technology described herein may be implemented in a wide range of embodiments using a wide array of mechanisms to allow the shoe to transition from the first position to the second position and/or to remain in one and/or both of the first position or second position.

The technology described herein may include a hinge in a layer in the sole of the shoe. Alternatively, the hinge may be connected to the sole of the shoe and/or connect two halves of the sole of the shoe. The shoe may also include a slide that allows a first part of the shoe to separate from, or connect to, a second part of the shoe. Separating the first part of the shoe from the second part of the shoe may allow the hinge to fold the shoe from the first position to the second position. The shoe may also, or alternatively, include an uplock, which may be used to limit and/or prevent the shoe from transitioning from the first position to the second position and/or from the second position to the first position.

Figure 1A:
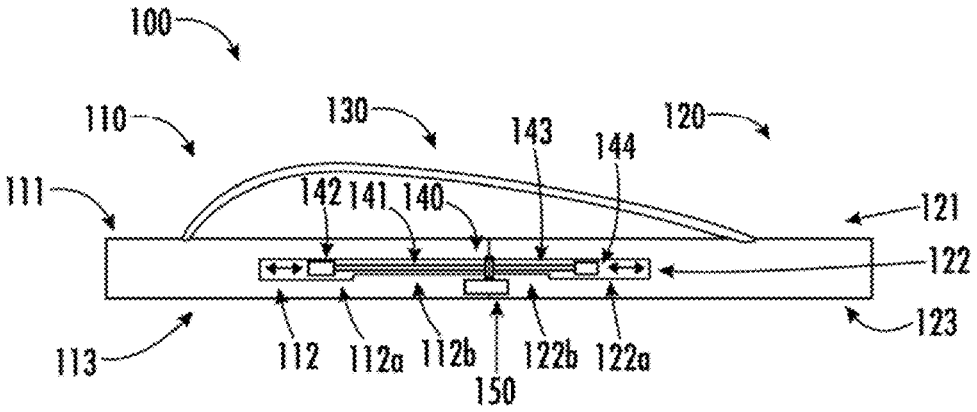
FIGS. 1A-1B illustrate an example shoe in which the technology described herein may be implemented.
Figure 1B:
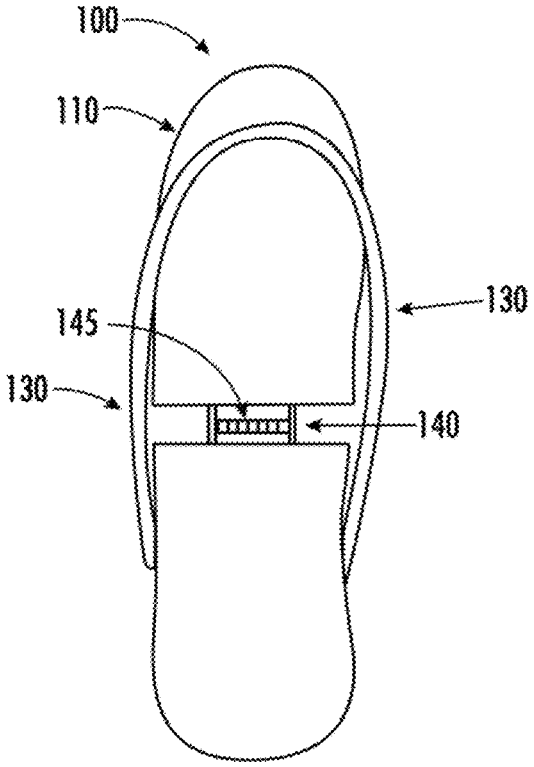

FIGS. 1A and 1B depict an example embodiment of a shoe 100 in which the technology described herein may be implemented. As shown in FIGS. 1A and 1B, shoe 100 may include a first sole section 110, a second sole section 120, an upper section 130, a hinge 140 and a retainer 150. The shoe 100 depicted in FIGS. 1A and 1B is provided for explanatory purposes only, and the disclosure herein is not intended to be limited to the embodiment depicted in FIGS. 1A and 1B. The technology described her may include additional components, fewer components, different components and/or differently arranged components than what is illustrated in FIGS. 1A and 1B. Also, in some implementations, one or more of the components described herein may perform one or more functions described as being performed by another of the components described herein. While the shoe described herein has a single-layer sole construction, other embodiments of the technology have additional layers (e.g. 2, 3, 4, 5, etc.) that form the sole.

First sole section 110 may correspond to a portion of the sole of shoe 100 that is foldably connected to second sole section 120. First sole section 110 may be the portion of the on which the wearer's toes and/or ball of the foot are positioned when shoe 100 is worn. First sole section may include a first toothed 111, a first cavity 112 and a first outsole 113. First footbed 111 may correspond to the portion of the first sole section 110 configured to receive a portion of (i.e. the toes, the ball, etc.) the user's foot (i.e. the surface on which a user's foot (or sock, hosiery, etc.) is placed when the shoe is worn) when shoe 100 is worn. First Outsole 113 is a portion of the first sole section 110 of shoe 100 which contacts the ground when the shoe 100 is worn, such as under the ball of a wearer's foot. First cavity 112 may correspond to a cavity within first sole section 110 in which first hinge section 141 resides. First cavity 112 may include a first cavity section 112*a*, having a first cross section, and a second cavity 112*b*, having a second cross section that is larger than the first cross section.

Second sole section 120 may be another section of the sole of shoe 100 that is foldably connected to first sole section 110 but is separate from first sole section 110 in that the two ma be easily folded relative to one another, meaning they are generally (although not always) separate pieces of material. Section sole section 120 may be the portion of the shoe on which a wearer's heel is positioned when shoe 100 is worn. Second sole section 120 may include the same or similar elements as first sole section 120. For example, second sole section 120 may include a second toothed 121, a second cavity 122 and a second outsole 123. Second footbed 121 may correspond to the portion of second sole section on which a user's foot (i.e. the heel, the remainder of the user's foot that is not on first footbed, etc.) is placed when shoe 100 is worn. Second outsole 123 is a portion of the sole of shoe which contacts the ground when shoe 100 is worn. Second cavity 122 may correspond to a cavity within second sole section 120 in which second hinge section 143 resides. Second cavity 122 may include a third cavity section 122*a* and a fourth cavity section 122*b*, the third cavity section 122*a* having a larger cross section than the fourth cavity section 122*b*.

Upper section 130 may be a portion of shoe that contacts and/or partially or completely surrounds the foot of a wearer of shoe 100 when shoe 100 is worn by the wearer. As shown in FIGS. 1A and 1B, upper section 130 may correspond to the straps of a sandal or flip-flops. In other embodiments, uppers section 130 may correspond to, for instance, the upper portion of a pair of flats, tennis shoes, heels, boots, etc. Upper section 130 extends from one or both of first sole section 110 or second sole section 120 and connects to the foot of a wearer when shoe 100 is worn.

Hinge 140 is connected to first sole section 110 and second sole section 120 and provides the foldable connection between these two sections. In other embodiments, hinge 140 may be connected to other sections of a shoe instead of or in addition to, first sole section 110 and second sole section 120, such as upper section 130. Hinge 140 may include a first hinge section 141 that is connected to first sole section 110 (i.e. glued to, mounted to, attached to, fastened to etc.) and/or disposed in first cavity 112. As shown in FIG. 1A, first hinge section 141 may extend in first cavity 112 and may include a stop 142. Stop 142 may fit within first cavity section 112*a* but be too large (i.e. have too large a cross section) to fit within section cavity section 112*b*. In this way, stop 142 allows the first hinge section 141 to slide within first cavity 112 without being pulled out front first cavity 112 because stop 142 is too large to slide in second cavity section 112*b*. In this way, first hinge section 141 allows hinge 140 to slide from first sole section 110, which may make it easier to fold shoe 100 between first sole section 110 and second sole section 120.

Hinge 140 may further include hinge section 145, or hinge mechanism 145, which provides the hinge function of hinge section. Hinge section 145 may be formed from one or more of a wide variety of mechanisms that may foldably connect first sole section 110 and section sole section 120. For example, but not limitation, hinge section 145 may include a spring hinge, a barrel hinge, a pivot hinge, a butt/mortise hinge, a case hinge, a continuous hinge, a butterfly hinge, a flag hinge, a strap hinge, a counterflap hinge, a flush hinge, a coach hinge, a rising butt hinge, a double action hinge, a tee hinge, a friction hinge, or any other foldable connection. Hinge section 145 may also be formed from, for instance, flexible material (e.g. cloth, rubber, plastics, etc.) that may be exposed when first section 110 separates from second section 120 and may then bend/flex/etc. to allow shoe 100 to be placed in a position for storage as described herein. Hinge section 145 may be connected to first hinge section 141 and second hinge section 142.

Similar to the operation of first hinge section 41, second hinge section 143 may be connected to second sole section 120 (i.e. glued to, mounted to, attached to, fastened to etc.) and/or disposed in second cavity 122. As shown in FIG. 1A, second hinge section 143 may extend in second cavity 122 and may include a stop 144. Stop 144 may fit within third cavity section 122*a* but be too large (i.e. have too large a cross section) to fit within fourth cavity section 122*b*. In this way, stop 144 allows the second hinge section 143 to slide within second cavity 122 without being pulled out from second cavity 122 because stop 144 is too large to slide in fourth cavity section 122*b*. In this way, second hinge section 143 allows hinge 140 to slide from second sole section 210, which may make it easier to fold shoe 100 between first sole section 110 and second sole section 120. As depicted in FIG. 1B, first hinge section 141 may be partially removed from first sole section 110 and second hinge section 143 may be partially removed from second sole section 120. This allows shoe 100 to fold about hinge section 145 from the first position of FIG. 1A, to a second, folded position (either the footbeds fold toward one another or the outsoles fold toward one another). By separating (i.e. sliding apart first sole section 110 and second sole section 120 (and preventing the two sections from contacting each other when folding), allows shoe 100 to fold until first outsole 113 contacts second outsole 123 and/or until first toothed 111 contacts second footbed 121. When shoe 100 is folded, upper section may fold, bend, separate, etc. to allow shoe to fold as described herein. In other embodiments, upper section 130 may include zippers, button, elastic material, etc. to allow shoe 100 to easily fold from a first position to a second position that is more compact than the first position.

Retainer 150 may be engaged to maintain shoe 100 in the first position to be worn and/or in the second, compact position, such as used for storage and/or transport. Retainer 150 may be formed from one or more retaining mechanisms, such as a clasp, a latch, magnetic latch, hasp, toggle clamp, hook and loop components, etc. In one embodiment, a single retainer 150 may be engaged to maintain shoe 100 in the position to be worn and may also be engaged to maintain shoe in a storage position. In other embodiments, a pair of retainers may be used, one to maintain shoe 100 in a position to be worn and another to maintain shoe 100 in a storage position.

Figure 2A:
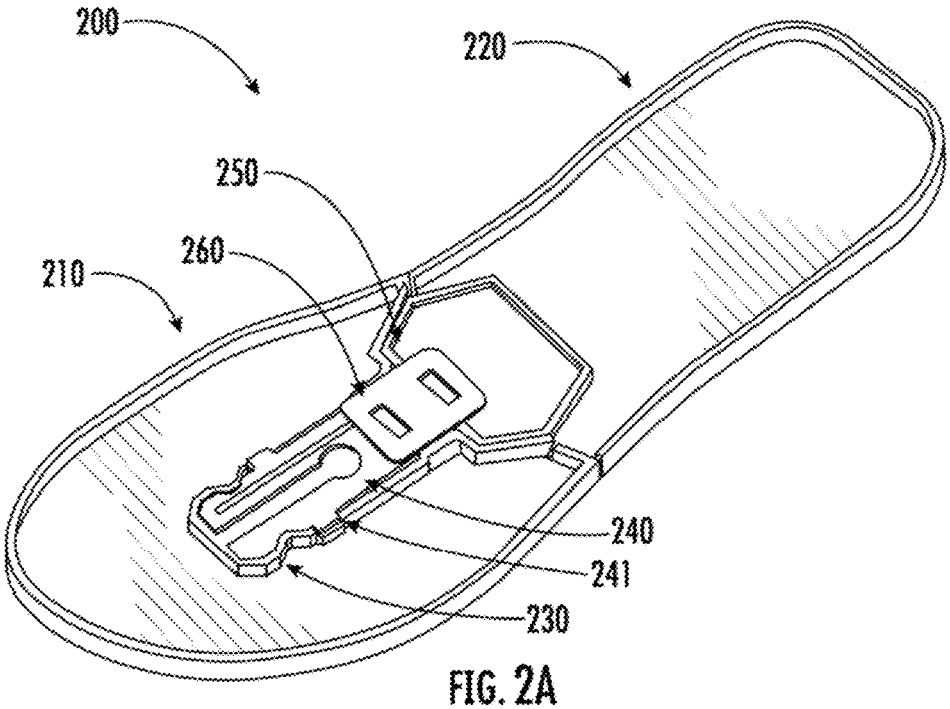
FIGS. 2A-2C illustrate a non-limiting example embodiment of a hinge.
Figure 2B:
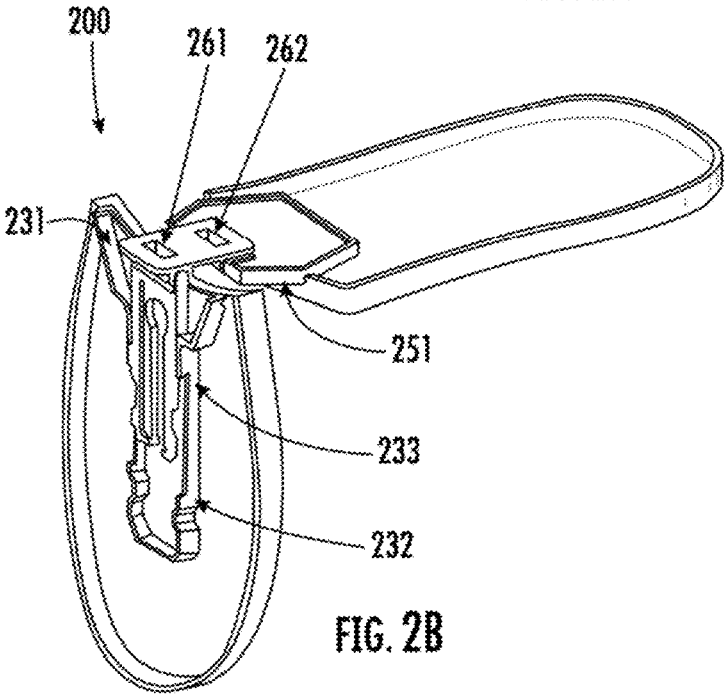
Figure 2C:
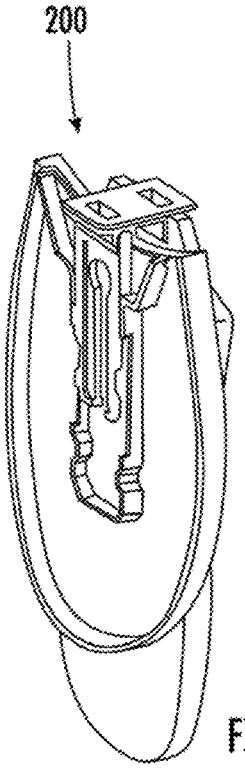

FIGS. 2A through 2C depict an example embodiment of a hinge 200 that may be used to implement the technology described herein. Hinge 200 may be connected to/placed within a shoe, such as shoe 100, in the same/similar fashion ways as hinge 140. As illustrated in FIGS. 2A through 2C, hinge 200 may include a first hinge section 210, a second hinge section 220, a slide 230, a slide member 240, a member 250 and a hinge section 260. The components illustrated in FIGS. 2A through 2C are provided for explanatory purposes only, and the disclosure herein is not intended to be limited to, or to require, the components provided therein or the embodiments depicted in the figures. Hinges anticipated by the present disclosure may include additional components, fewer components, different components, an/or differently arranged or designed components than illustrated in FIGS. 2A through 2C. Also, in some implementations, one or more of the components of hinge 200 may perform one or more functions described as being performed by another one or more of the components of hinge 200.

First hinge section 210 may connect to a first sole member, such as first sole member 110, in the ways described herein (e.g. fastened or adhered between, under or above other layer(s) of first sole member, etc.). While first hinge section 210 and second hinge section 220 are depicted as extending far the entire length and width of the sole of a shoe, either or both of first hinge section 210 or second hinge section 220 may extend for only a portion of a sole of a shoe or may merely connect to some portion of a sole of a shoe. First hinge section 210 and second hinge section 220 may connect the hinge member 260 to a shoe and may allow the sole of a shoe to slide and/or separate into two parts. For example, first hinge section 210 may include slide 230 and slide member 240. Slide 230 and slide member 240 may include structural designs and/or mechanisms that allow first hinge section 210 and second hinge section 220 to separate or slide apart when a slide member 240 moves across slide 230. Slide 230 may include a channel (a portion of slide 230 within which slide stop 241 may be positioned) defined by first channel end 232 and second channel end 231. Slide stop 241 of slide member 240 may slide between first channel end 232 and second channel end 233 to provide the sliding or separating function as described herein. Slide stop 241 may be contact each of first channel end 232 and second channel end 233 to define a distance that first hinge section 210 may separate slide away from second hinge section 220. Sliding and/or separating may allow a shoe to rotate further (i.e. additional degrees of rotation than if no sliding and/or separating is present) and/or become more compact when the shoe is folded for storage.

Second hinge section 220 may be connected to the sole of a shoe, such as second sole member 120, in the ways described herein. Second hinge section 220 may include hinge plate 250. Hinge plate 250 may overhang a portion of second hinge section 220 and, when hinge 200 is in the position to be worn as shown in FIG. 2A, a portion of hinge plate 250 may be placed over a surface of first hinge section 210. In this configuration, hinge plate surface 251 of hinge plate 250 may contact slide surface 231 when hinge 200 is in the position to be worn and/or define the wearing position of hinge 200.

Hinge 260 may connect to first hinge section 210 and second hinge section 220 and may include a first hinge 261, about which first hinge section 210 rotates, and a second hinge 262 about which second hinge section 220 rotates. Each of first hinge 261 and second hinge 262 may be formed from the hinge mechanisms described herein and may allow hinge 200 to fold in the ways described herein. While hinge section 260 is shown as having two separate hinge members, hinge section 260 may include a single hinge member, three hinge members, four hinge members, etc. As shown in FIG. 2C, the folding action provided by hinge section 260 allows hinge 200 to be placed in a folded position that is more compact than when hinge 200 in position for wearing a shoe, as shown in FIG. 2A.

Figure 3:
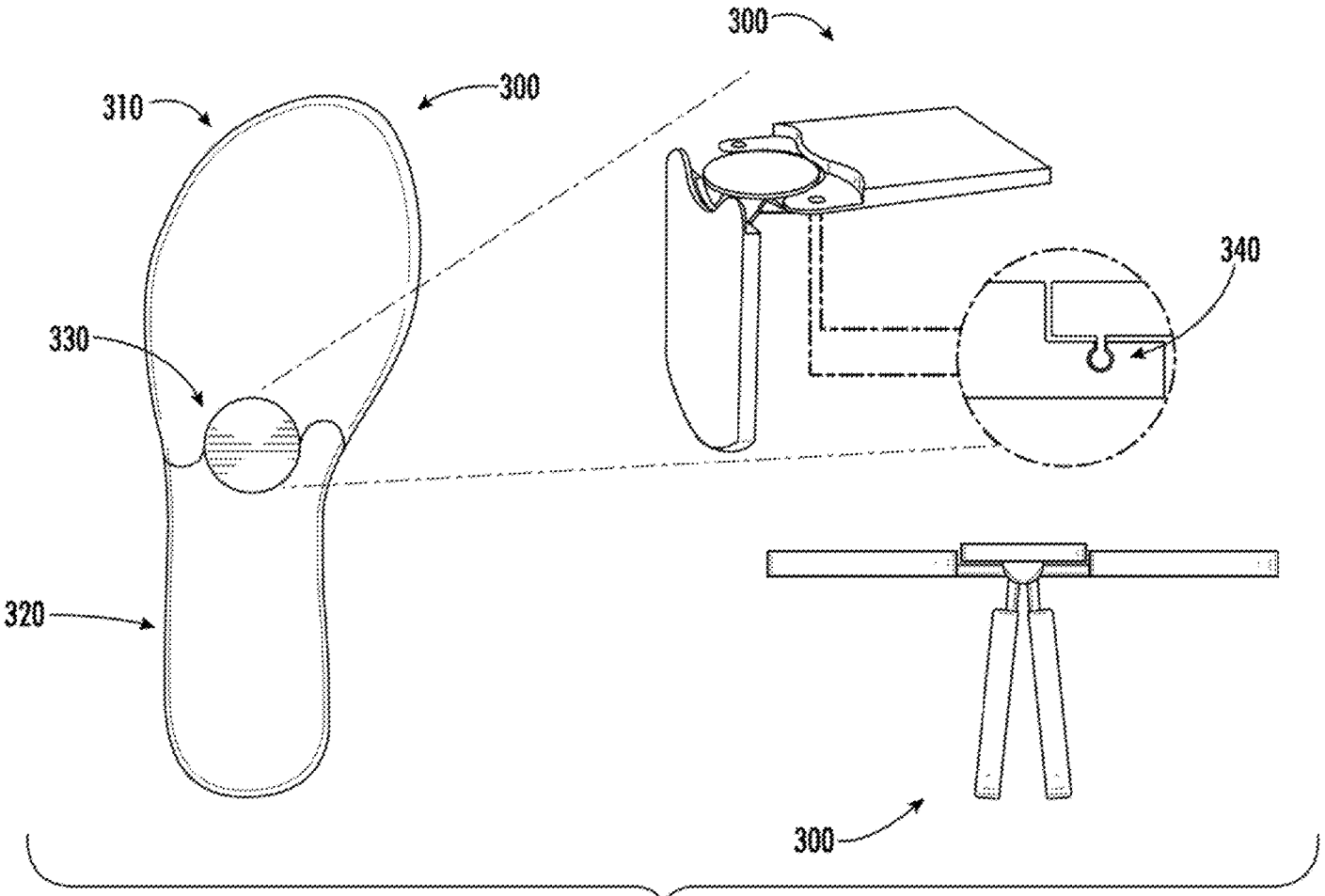
FIG. 3 illustrates an alternative non-limiting example embodiment of a hinge.

FIG. 3 depicts another example embodiment of a hinge 300 that may be used to implement the technology described herein. As illustrated in FIG. 3, hinge 300 may include a first section 310, a second section 320, a hinge section 330, and retainer 340. First section 310 and second section 320 may be connected to hinge section 330, which is depicted to include one or more hinge members about which each of first section 310 and second section 320 may rotate. As illustrated in FIG. 3, a portion of first section 310 may overlap second section 320 when hinge 300 is in a position for wearing (shown on left of FIG. 3). Hinge 300 may also include retainer 340. In this embodiment, retainer 340 may maintain hinge 300 in a position to be worn. Here, retainer 340 includes a pin (e.g. an extension with a larger tip) that extends from, for example, hinge section 330 and/or second section 320 to engage a recess (e.g. a corresponding aperture) in first section 310. The components illustrated in FIG. 3 are provided for explanatory purposes only, and the disclosure herein is not intended to be limited to, or to require, the components provided therein or the embodiments depicted in the figures. Hinges anticipated by the present disclosure may include additional components, fewer components, different components, and/or differently arranged or designed components than illustrated in FIG. 3. Also, in some implementations, one or more of the components of hinge 300 may perform one or more functions described as being performed by another one or more of the components of hinge 300.

Figure 4:
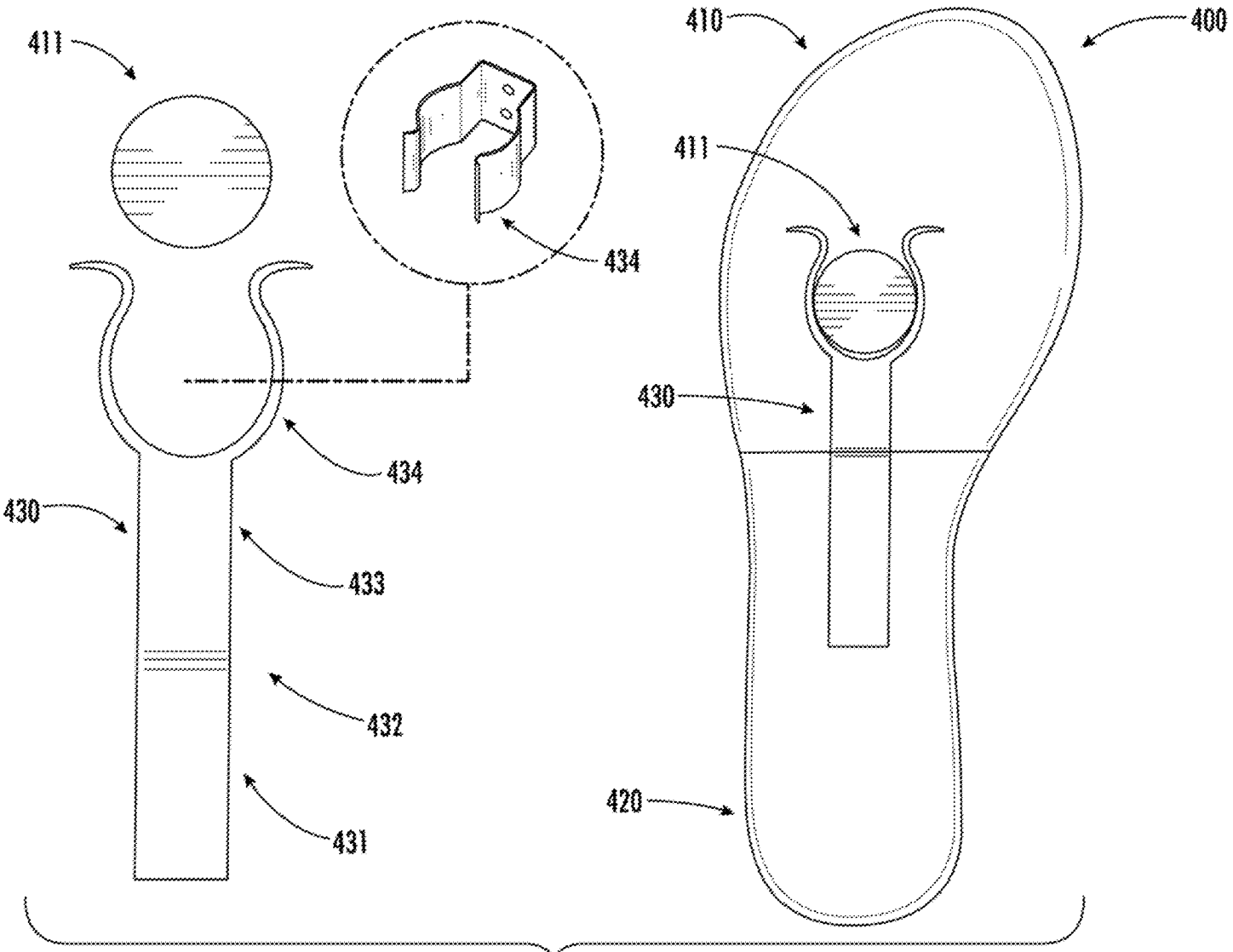
FIG. 4 illustrates yet another alternative non-limiting example embodiment of a hinge.

FIG. 4 depicts another example embodiment of a hinge 400 that may be used to implement the technology described herein. As illustrated in FIG. 4, hinge 400 may include a first section 410, a second section 420, and a hinge section 430. First section 410 and second section 420 mays be connected to hinge section 430. Hinge section 430 may include a first hinge section 431 that is connected to second section 420, a hinge member 432, or hinge mechanism 432, and a second hinge section 433. Hinge member 432 may be one or more of the hinge mechanisms described herein. Second hinge section 433 may include a clamp 434 that a may engage a post 411, which extends from and is connected to first section 410. In this configuration, clamp 434 may be used to connect hinge section 430 to first section 410 in a way that allows first section 410 to slide and/or separate from second section 420, which may be helpful when placing a shoe in which hinge 400 is located into a storage position. The components illustrated in FIG. 4 are provided for explanatory purposes only, and the disclosure herein is not intended to be limited to, or to require, the components provided therein or the embodiments depicted in the figures. Hinges anticipated by the present disclosure may include additional components, fewer components, different components, and/or differently arranged or designed components than illustrated in FIG. 4. Also, in some implementation one or more of the components of hinge 400 may perform one or more functions described as being performed by another one or more of the components of hinge 400.

Figure 5A:
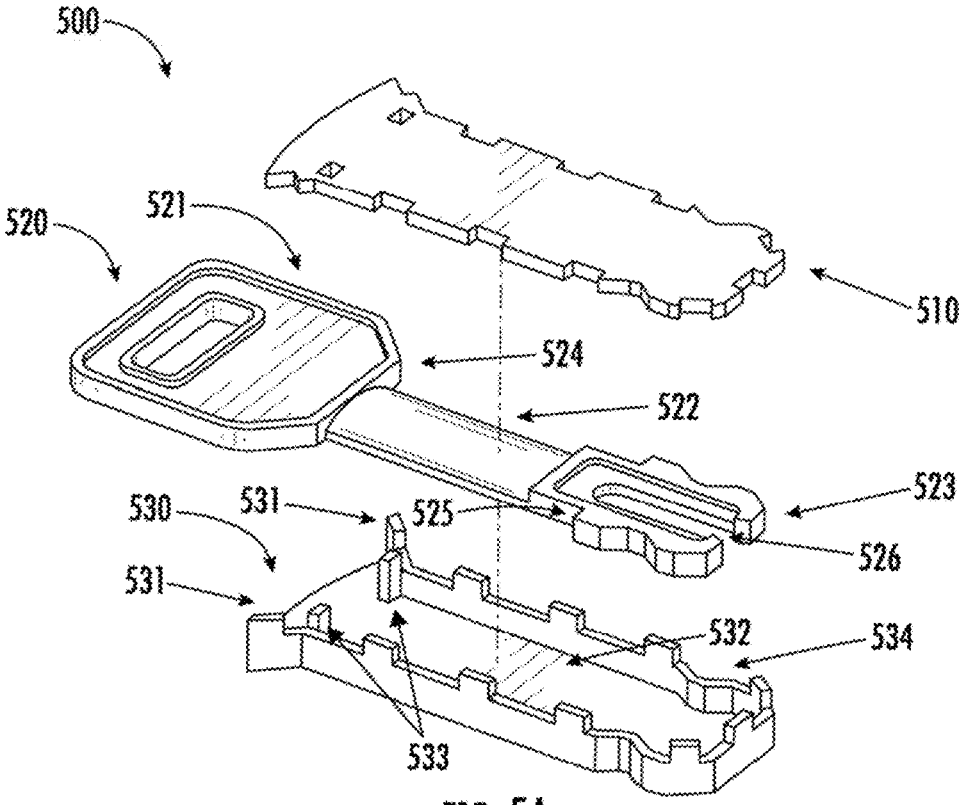
FIGS. 5A-5C illustrate another alternative non-limiting example embodiment of a hinge.
Figure 5B:
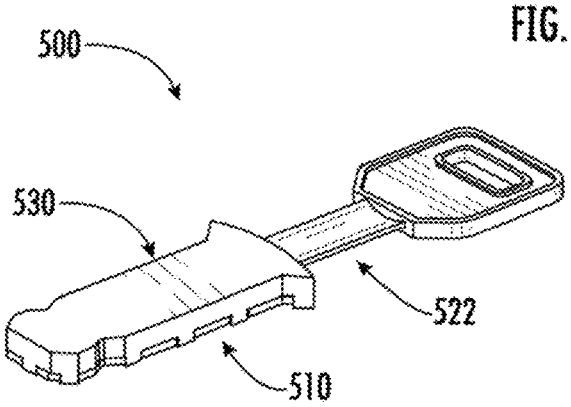
Figure 5C:
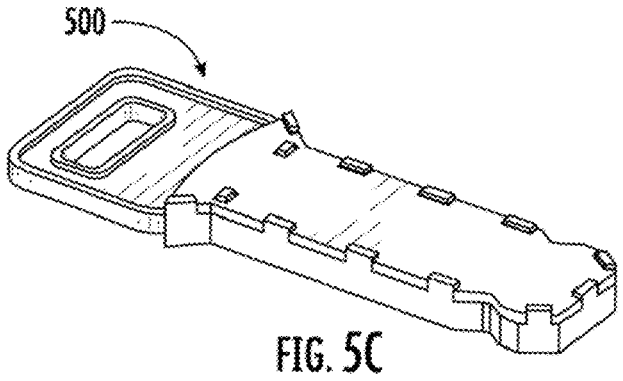

FIGS. 5A-5C depict an example embodiment of a hinge 500 that may be used to implement the technology described herein. As illustrated in FIGS. 5A-5C, hinge 500 may include a cover 510, a slide member 520, and a slide 530. The components illustrated in FIGS. 5A-5C are provided for explanatory purposes only, and the disclosure herein is not intended to be limited to, or to require, the components provided therein or the embodiments depicted in the Figures. Hinges anticipated by the present disclosure may include additional components, fewer components, different components, and/or differently arranged or designed components than illustrated in FIGS. 5A-5C. Also, in some implementations, one or more of the components of hinge 500 may perform one or more functions described as being performed by another one or more of the components of hinge 500.

Slide member 520 may be a portion of hinge 500 that moves within slide 530 to allow a shoe to which hinge 500 is connected to separate into two parts in order for the shoe to be folded. Slide 530 may be a portion of hinge 500 which provides the path along which slide member 520 moves to separate a shoe. Slide 530 may also, or alternatively, provide a way to retain slide member 520 in a closed position, which may correspond to a shoe being placed in a position to be worn. For example, slide 530 may include a channel portion 532 in which slide member 520 may move from a first (open or folding) position to second (closed or wearing) position to allow hinge 500 to separate (such as when the shoe is folded in first position) and be placed back together (such as to be worn). Slide member 520 may include a head 521, a neck 522 and a key 523. Neck 522 may be formed from a flexible material that allows hinge 500 to bend to allow shoe to fold. In one embodiment, neck 522 is formed from a different, more flexible and durable (i.e. withstands repeated bending) material that the other components of slide member 520. In another embodiment, neck 522 is formed from the same material as the rest of slide member 520 (which may be the same material as the other components of hinge 500), and the relatively thin (compared to the rest of slide member 520) cross section of neck 522 makes it easily bendable when a user desires to fold a shoe to which hinge is attached. In this embodiment, the thicker cross sections of the rest of slide member 520 make them resistant to bending, which limits and/or prevents folding the shoe when the shoe is in a wearing position. In other embodiments, neck 522 includes a hinge mechanism (not shown) as described herein that allows neck 522 to fold along the hinge mechanism to fold shoe 600 for storage, etc.

As shown in FIG. 5B, hinge 500 may be placed in a folding position in which a portion of neck 522 is removed from slide 530 and cover 510. In this position, neck 522 may bend to allow hinge 500 to fold or bend, which may allow a shoe to be placed in the closed position. As shown in FIG. 5C, hinge 500 may be placed in a closed position in which neck 522 is located completely within cover 510 and slide 530. In this position, hinge 500 may not fold because neck 522 is located completely within a housing formed by cover 510 and slide 530.

Slide member 520 may include key 523, which may be formed to interlock with lock 534 of slide 530. As can be seen in FIG. 5A, key 523 may have a slot 526 which may allow key 523 to be compressed to allow it to slide into lock 534 to define the second (closed or wearing) position. Once key 523 is located within lock 534, slot 526 may return to its original size to maintain key 523 in lock 534, which may help keep a shoe from separating and/or folding unexpectedly. Additionally, head 521 may include a head surface 524 that may contact slide surface 531 to set the second position. In the second position, head 521 may be partially located within cover 510 and slide 530, which may further prevent hinge 500 from folding in this position when head 521, cover 510 and slide 530 are formed from rigid materials (e.g. metals, hard plastics, etc.).

In order to separate hinge 500 to the first position shown in FIG. 5B, slide member 520 may be pulled away from the first position when enough force is used to compress slot 526 to allow key 523 to slide out from lock 534 and allow slide member 250 (key 523 and neck 522) to slide along channel 532 until stops 525 of slide member 520 contact stop members 533, which prevent slide member 520 from being removed from slide 530 once cover 510 is installed. In this position, some portion of neck 522 is removed from cover 510 and slide 530, allowing neck 522 to bend.

Figure 6:
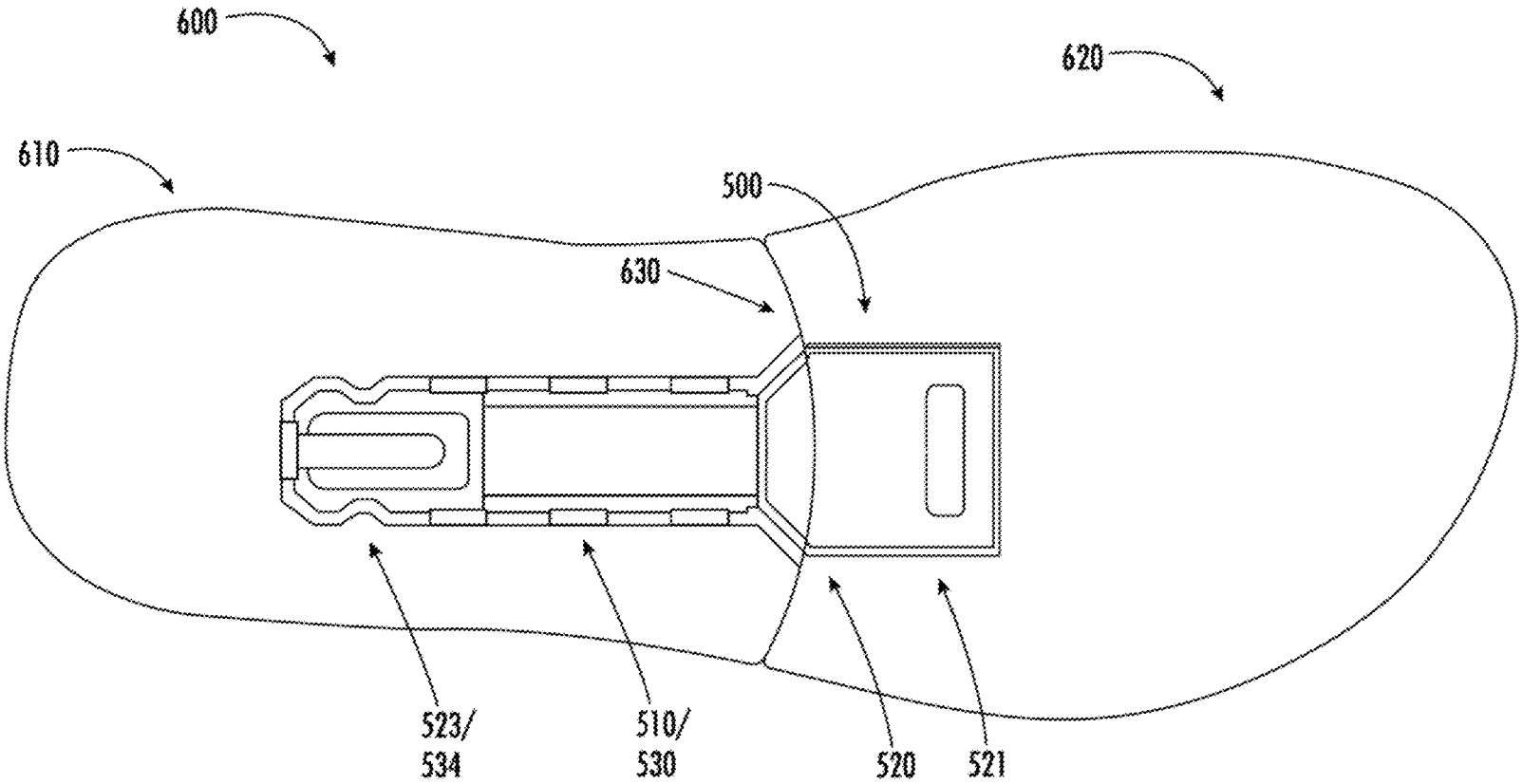
FIG. 6 illustrates an example shoe into which the hinge of FIGS. 5A-5C is incorporated.

FIG. 6 depicts an example shoe 600 that may include hinge 500 to allow shoe 600 to be folded. As can be seen in FIG. 6, shoe 600 may include a first sole section 610 to which cover 510 and/or slide 530 is attached. Shoe may further include a second sole section 620 to which a portion of head 521 may be attached. Shoe 600 may include a parting line 630, which may correspond to the area where first sole section 610 meets second sole section 620, which may be proximate to where shoe 600 folds. When hinge 500 is separated, slide member 520 may move along slide 530 to remove a portion of neck 522 from cover 510 and slide 530 (as shown in FIG. 5B) and shoe will be divided into between first sole section 610 and second sole section 620, each of which are depicted as being connected to an upper section. Slide member 520 may bend or fold along the exposed portion of neck 522 to allow the shoe to fold when separated (not shown). FIG. 6 depicts shoe 600 in the wearing, or closed position in which key 523 fits is located within lock 534 to maintain hinge 500 in this position and/or to prevent shoe 600 from inadvertently becoming unfolded.

Figure 7:
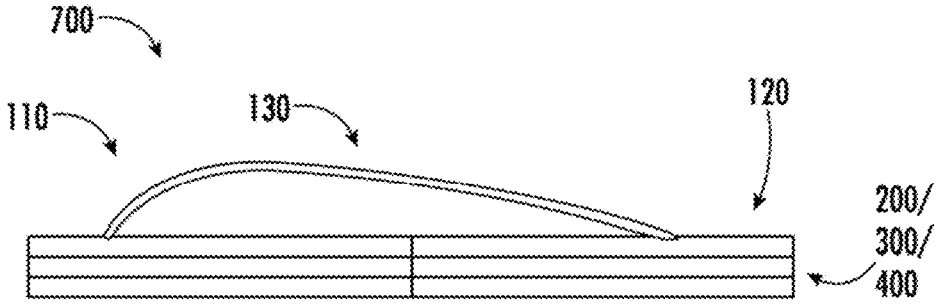
FIG. 7 illustrates an example shoe depicting the implementation of the hinges of FIGS. 2-4.

FIG. 7 depicts a non-limiting example of a shoe depicting how a hinge, as described herein, may be implemented. As depicted in FIG. 7, the shoe 700 may include a hinge, such as hinge 200, hinge 300 or hinge 400 rather than hinge 140 as described with regard to shoe 100. Otherwise, shoe 700 may be the same as/similar to shoe 100. For example, shoe 700 may include a first sole section 110, second sole section 120 and an upper sole section 130, as well as one of the hinges 200, 300 or 400. FIG. 7 is provided to show one example of how hinge 200, hinge 300 and hinge 400 may be implemented.

Figure 8A:
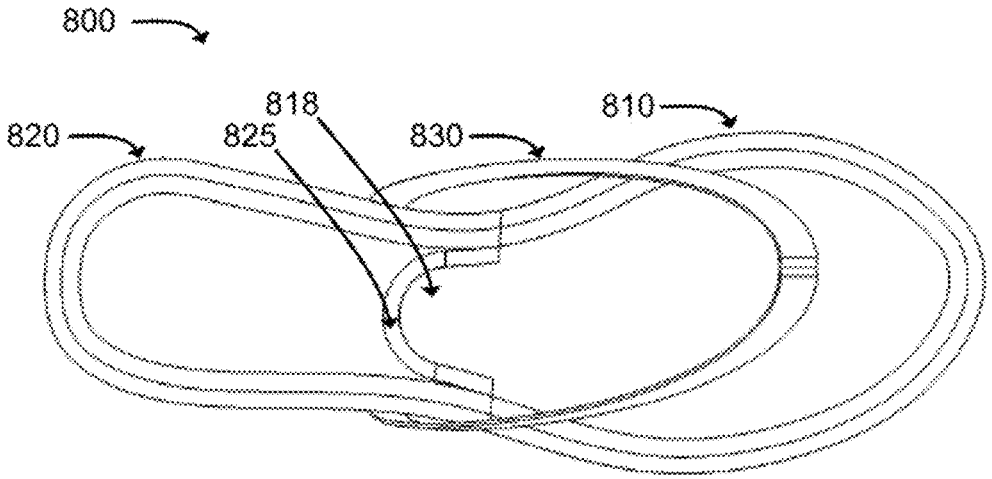
FIGS. 8A-8C illustrate another example folding shoe in which the technology described herein may be implemented.
Figure 8B:
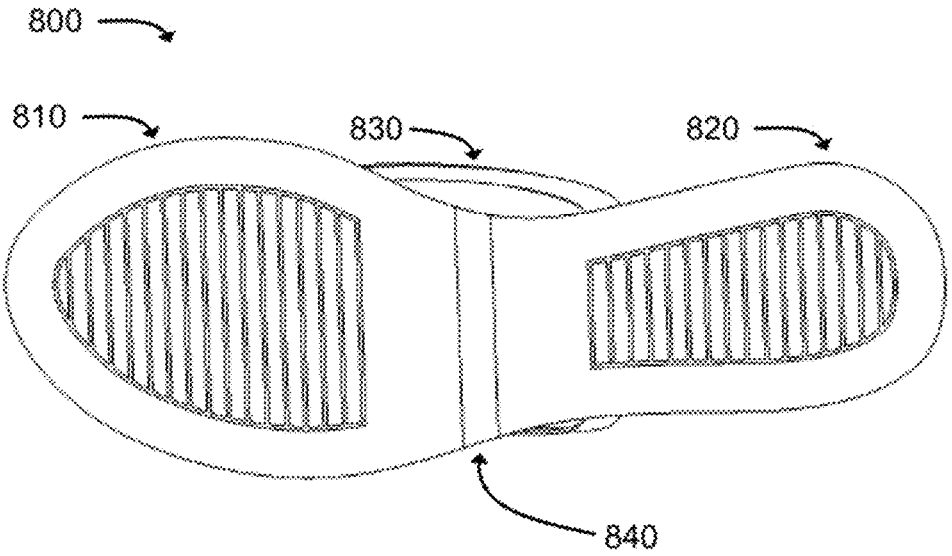
Figure 8C:
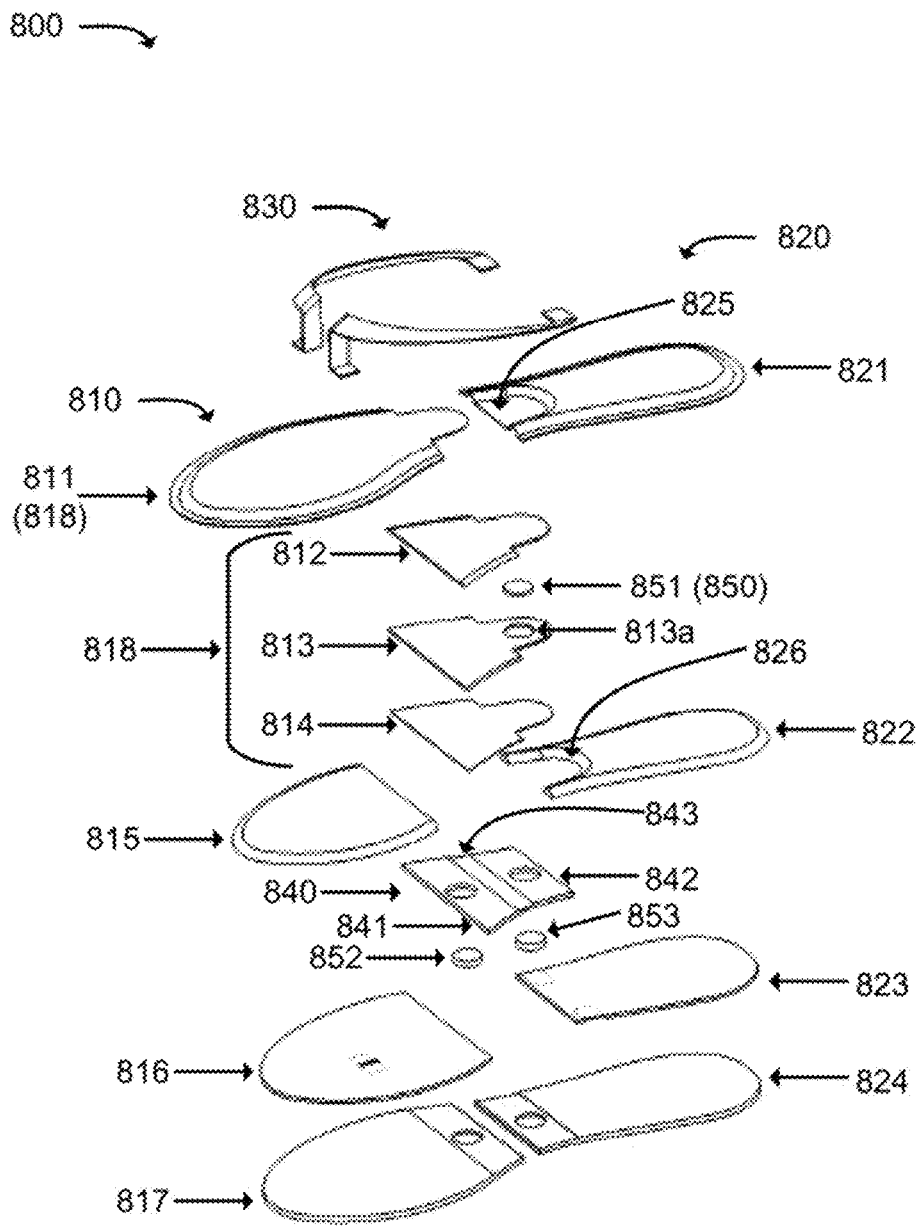

FIGS. 8A-8C depict an example embodiment of a shoe 800 in which the technology described herein may be implemented. As shown in FIGS. 8A and 8B, shoe 800 may include a first sole section 810, a second sole section 820, an upper section 830, and a hinge 840. As discussed in relation to FIG. 8C, shoe 800 may be magnetically retained in the first position and the second position using magnets 850, which serve as a retainer. There are a variety of ways anticipated by this disclosure to use magnets to maintain a foldable shoe in the first position and/or second position. FIG. 8C reflects a tab 818 extending from first sole section 810 that includes a first magnet 851 and nests within a tab recess 825, which includes third magnet 853 that magnetically connects to first magnet 851 to maintain shoe 800 in the first position (i.e. open to wear). A hinge 840 connects the first sole section 810 and the second sole section 820 and is foldable from the first position to the second position. Second magnet 852 and third magnet 853 may magnetically maintain shoe 800 in the second position (i.e. folded). The shoe 800 depicted in FIGS. 8A through 8C is provided for explanatory purposes only, and the disclosure herein is not intended to be limited to the embodiment depicted in FIGS. 8A and 8C. The technology described herein may include additional components, fewer components, different components and/or differently arranged components than what is illustrated in FIGS. 8A to 8C. Also, in some implementations, one or more of the components described herein may perform one or more functions described as being performed by another of the components described herein. While the shoe described herein has a multi-layer sole construction, other embodiments of the technology have fewer or additional layers that form the sole. The particular embodiment described in FIGS. 8A to 8C is only an example embodiment of the present disclosure.

FIG. 8C reflects an exploded view of the example shoe 800 to identify the particular composition of shoe 800. In this embodiment, shoe 800 includes a first sole section 810, a second sole section 820, an upper section 830 and a hinge 840. Upper section 830 extends from, and is connected to, first sole section 810 and/or second sole section 820. Hinge 840 connects first sole section 810 and second sole section 820.

First sole section 810 includes a first footbed 811, a first tab member 812, a second tab member 813, a third tab member 814, a first support member 815, a first hinge extension 816 and a first outsole 817. Tab 818 may be formed from portions of first footbed 811, first table member 812, second tab member 813 and third tab member 814. First magnet 851 may be disposed in tab 818, such as by being placed within an aperture 813*a* of second tab member 813. First tab member 812 and third tab member 814 may be connected (i.e. sewn, glued, a combination, etc.) to opposing sides of second tab member 813 to maintain first magnet 851 within aperture 813*a* of second tab member 813 to maintain the position of first magnet 851 in tab. First footbed 811 may be further connected to first tab member 812, second tab member 813 and third tab member 814 to form tab 818. Tab 818 may extend from first sole section 810 to overlap second sole section 820 (i.e. in the area of tab recess 825) so that a magnetic connection between first magnet 851 and third magnet 853 maintains shoe 800 in the first position. First support member 815 may be located between first footbed 811 and first hinge extension 816. The combined thickness of first support member 81 and first hinge extension 816 may be close to/approximately equal to the thickness combined thickness of first tab member 812, second tab member 813, third tab member 814 and hinge 840 so that the thickness of first sole section 810 is consistent. A first outsole 817 may be located on the opposite side of first hinge extension 816 from first support member 815. First outsole 817 reflects a recess for hinge 840 and second magnet 852, which may locate second magnet 852 and/or provide for a uniform thickness of first sole section 810. First sole section 810 is shown as having several layers and components, however, in practice, there may be additional layers and components, fewer layers and components and/or differently arranged layers and components. The layers and components displayed in connection with first sole section 810 provide a variety of known functions, including support, comfort, etc. The layers and components of first sole section may be connected in a variety of ways that are known in the art, including stitching, adhesives, a combination, etc. One side of hinge 840 may be included in this connection to ensure that hinge 840 is connected to first sole section 810.

Hinge 840 may be foldable to allow shoe 840 to be transferred from the first position to the second position. As reflected in FIG. 8C, hinge 840 may be a "live hinge" or "living hinge", meaning it is formed from a material that is configured to be folded from the first position to the second position a number of times without failing and/or breaking along a fold line. Good example materials for a "live hinge" include any material that is flexible and that can elastically (or, less favorably, plastically) deform to fold the shoe 800 from the first position to the second position. For example, polypropylene is a common material used for live hinges, but many other materials (polyethylene, rubbers, other synthetics, performance fabrics such as those made from ultra-high-molecular-weight polyethylene, reinforced fabrics, etc.). As reflected in FIG. 8C, hinge 840 may be connect first sole section 810 to second sole section 820. The connection to first sole section 810 (i.e. extending from first hinge extension 816 anchor first support member 815) and second sole section 820 (i.e. extending from second hinge extension 823 and/or second support member 822, hinge 840 having approximately the same thickness as the hinge extensions) may be the same as, or similar to, the connections used in other portions of first sole section 810 and/or second sole section 820 (i.e. to connect the other layers or components of each). In another embodiment, hinge 840 extends the length of shoe 800, eliminating the hinge extensions. As reflected in FIG. 8C, hinge 840 may have a first hinge section 841 which is disposed in and/or connected to first sole section 810 and which includes and/or is adjacent to second magnet 852. Hinge 140 may have a second hinge section 842 that is disposed in and/or connected to second sole section 820 and which includes and/or is adjacent to third magnet 853. A hinge mechanism 843 (i.e. the portion of hinge 840 that folds) may be disposed between the first hinge section 841 and the second hinge section 842. Second magnet 852 and third magnet 853 may connect to maintain shoe 800 in the second, or closed, position in which the two outsoles (first outsole 817 and second outsole 824 are touching. This may be an ideal second position because the portions of first outsole 817 and second outsole 824 which contact the ground are in contact and/or acing one another in the second position, which may limit and/or prevent soiled outsoles from soiling other items.

Second sole section 820 includes a second footbed 821, a second support member 22, a second hinge extension 823 and a second outsole 824. As provided in FIG. 8C, tab recess 825 may be formed as a part of second footbed 821 and may provide an area on which/volume in which tab 818 is disposed when shoe 800 is in the first position such that, when the shoe 800 is in the first position, tab 818 is generally level with the rest of first sole section 810 and second sole section 820 as a result of being disposed within tab recess 825 (i.e. tab recess 825 may depend downwards from an upper surface of second footbed 821 by an amount equal to, or approximately equal to, the thickness of tab 818. Second support member 822 may be located between second footbed 821 and second hinge extension 823 and may include a cavity 826 in which tab recess 825 is disposed. A second hinge extension 823 may extend from second hinge section 842. A second outsole 824 may be located on the opposite side of second hinge extension 823 from second support member 822. Second outsole 824 reflects a recess for hinge 840 and third magnet 853, which may locate third magnet 853 and/or provide for a uniform thickness of second sole section 820. Second sole section 820 is shown as having several layers and components, however, in practice, there may be additional layers and components, fewer layers and components and/or differently arranged layers and components. The layers and components displayed in connection with second sole section 820 provide a variety of known functions, including support, comfort, etc. The layers and components of second sole section may be connected in a variety of ways that are known in the art, including stitching, adhesives, a combination, etc. Upper section 830 may extend from and be connected to first sole section 810 and/or second sole section 820. While upper sole section 830 is depicted as straps for sandals or flip flops, the present disclosure anticipates a wide variety of other known upper shoe section designs and connections.

Magnets 850 (first magnet 821, second magnet 852 and third magnet 853) may be formed from a variety of magnets (any known variety of magnets) or other magnetic materials (i.e. iron, nickel, cobalt, neodymium, samarium, magnetic rare earth metals, or other magnetic elements or alloys including such elements). While the term "magnet" is used in this disclosure, a magnetic material may be substituted for one or more of the magnets, and the magnetic connections described herein may still be present. "Magnetic material", when used herein, refers to magnets and magnetic materials.

In one embodiment third magnet 853 may be an actual magnet, while first magnet 851 and second magnet 852 may be magnetic materials other than magnets. In this embodiment, the third magnet 853 will be magnetically attracted to the magnetic materials of first magnet 851 and second magnet 852 in the first position and second position, respectively. Alternatively, first magnet 851 and second magnet 852 may be magnets while third magnet 853 may be a magnetic material other than a magnet, which may provide the same magnetic connections at the first position and second position.

The foregoing description provides illustration and description, but is not intended to be exhaustive or to limit the implementations to the precise form disclosed. Modifications and variations are possible in light of the above disclosure or may be acquired from practice of the embodiments. It should be emphasized that the terms comprises and comprising, when used in this specification, are taken to specify the presence of stated features, integers, steps or components but do not preclude the presence or addition of one or ore other features, integers, steps, components or groups thereof.

Even though particular combinations of features are recited in the claims and/or disclosed in the specification, these combinations are not intended to limit the disclosure of the embodiments. In fact, many of these features may be combined in ways not specifically recited in the claims and/or disclosed in the specification.

No element, act, or instruction used in the present application should be construed as critical or essential to the implementations unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. A foldable shoe comprising:

a first sole section configured to be positioned under the ball of a wearer's foot, the first sole section including a first outsole portion configured to contact the ground when the foldable shoe is worn, a first footbed configured to receive a user's foot when the foldable shoe is worn, and a tab extending from the first sole section;

a second sole section that is separate from the first sole section and is configured to be positioned under the heel of a wearer's foot, the second sole section including a second outsole portion configured to contact the ground when the foldable shoe is worn, a second footbed configured to receive a user's heel when the foldable shoe is worn, and a tab recess, an upper section extending from the first sole section;

a hinge connected to the first sole section and the second sole section, the hinge configured to fold the foldable shoe from a first position, in which the tab overlaps the tab recess and the foldable shoe is configured to be worn, to a second position, in which either the first outsole section and second outsole section fold toward one another, or the first footbed and second footbed fold toward one another; and a first magnetic material disposed in the tab of the first sole section and a second magnetic material disposed in the second sole section, the first magnetic material and second magnetic material creating a magnetic connection to retain the foldable shoe in the first position or the second position.

2. The foldable shoe of claim 1 where the first sole section includes a tab and the second sole section includes a tab recess, the tab being disposed in the tab recess when the shoe is in the first position.

3. The foldable shoe of claim 1, where the hinge further includes a first hinge section connected to the first sole section, a second hinge section connected to the second sole section and a hinge mechanism, the hinge mechanism being connected to the first hinge section and the second hinge section and configured to permit the foldable shoe to fold.

4. The foldable shoe of claim 2 where the first magnetic material is disposed in the tab.

5. The foldable shoe of claim 3 where the hinge corresponds to a live hinge.

6. The foldable shoe of claim 1 further including a third magnetic material, the magnetic connection maintaining the foldable shoe in the first position and a second magnetic connection between the second magnetic material and the third magnetic material maintaining the foldable shoe in the second position.

7. The foldable shoe of claim 6 where the first magnetic material, second magnetic material and third magnetic material are formed from magnets.

8. The foldable shoe of claim 6 where one of the first magnetic material, second magnetic material or third magnetic material is formed from iron, nickel, cobalt, neodymium, samarium, or a magnetic rare earth metal or an alloy comprising iron, nickel, cobalt, neodymium, samarium, or a magnetic rare earth metal.

9. The foldable shoe of claim 2 where the second magnetic material is disposed between the tab recess and the second outsole portion of the second sole section.

10. The foldable shoe of claim 6, where the third magnetic material is disposed in the first sole section.

11. The foldable shoe of claim 1, where the upper section is connected to the second sole section.

12. The foldable shoe of claim 3 where a first hinge extension is disposed adjacent to the first hinge section in the first sole section.

13. The foldable shoe of claim 12 where a second hinge extension is disposed adjacent to the second hinge section in the second sole section.

14. The foldable shoe of claim 1 where the tab recess is disposed in the second footbed.

15. A foldable shoe comprising:

a first sole section configured to be positioned under the ball of a wearer's foot, the first sole section including a first outsole portion configured to contact the ground when the foldable shoe is worn and a first footbed configured to receive a user's foot when the foldable shoe is worn;

a second sole section that is separate from the first sole section and is configured to be positioned under the heel of a wearer's foot, the second sole section including a second outsole portion configured to contact the ground when the foldable shoe is worn and a second footbed configured to receive a user's heel when the foldable shoe is worn, an upper section extending from the first sole section;

a hinge connected to the first sole section and the second sole section, the hinge configured to fold the foldable shoe from a first position, in which the foldable shoe is configured to be worn, to a second position, in which either the first outsole section and second outsole section fold toward one another, or the first footbed and second footbed fold toward one another;

a first magnetic material disposed in the first sole section and a second magnetic material disposed in the second sole section, the first magnetic material and second magnetic material creating a magnetic connection to retain the foldable shoe in the first position; and a third magnetic material that creates a second magnetic connection to retain the foldable shoe in the second position.

16. The foldable shoe of claim 15 where the first magnetic material, second magnetic material and third magnetic material are formed from magnets.

17. The foldable shoe of claim 15 where the third magnetic material is disposed in the first sole section.

18. The foldable shoe of claim 15 where the first sole section includes a tab and the second sole section includes a tab recess, the tab overlapping the tab recess when the shoe is in the first position.

19. The foldable shoe of claim 15 where the hinge corresponds to a live hinge.

* * * * *